US007390084B2

(12) United States Patent
Folkins

(10) Patent No.: US 7,390,084 B2
(45) Date of Patent: Jun. 24, 2008

(54) INK JET PRINTER HAVING MULTIPLE TRANSFIXING MODES

(75) Inventor: Jeffrey J. Folkins, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 429 days.

(21) Appl. No.: 11/120,343

(22) Filed: May 3, 2005

(65) Prior Publication Data

US 2006/0250467 A1 Nov. 9, 2006

(51) Int. Cl.
*B41J 2/01* (2006.01)

(52) U.S. Cl. ..... 347/103; 347/104; 347/102; 347/101; 101/490; 399/384

(58) Field of Classification Search ..... None
See application file for complete search history.

(56) References Cited

U.S. PATENT DOCUMENTS 4,538,156 A * 8/1985 Durkee et al. ..... 346/21
5,099,256 A 3/1992 Anderson
5,132,739 A * 7/1992 Mauer et al. ..... 399/325
5,365,261 A * 11/1994 Ozawa et al. ..... 347/103
5,389,958 A 2/1995 Bui et al.
5,448,276 A * 9/1995 Hirabayashi et al. ..... 347/103
5,841,456 A * 11/1998 Takei et al. ..... 347/103
6,173,136 B1 * 1/2001 Fuchiwaki et al. ..... 399/67
6,196,675 B1 3/2001 Deily et al.
6,318,853 B1 * 11/2001 Asano et al. ..... 347/103
6,494,570 B1 12/2002 Snyder
6,527,386 B1 * 3/2003 Blank et al. ..... 347/103
6,648,466 B2 * 11/2003 Beauchamp et al. ..... 347/103
6,679,599 B2 * 1/2004 Jurrens et al. ..... 347/102
6,739,683 B2 * 5/2004 Shimomura et al. ..... 347/8
6,763,219 B2 * 7/2004 Kobayashi et al. ..... 399/401
7,065,308 B2 * 6/2006 Calamita et al. ..... 399/66
2006/0066657 A1 * 3/2006 Folkins et al. ..... 347/19

OTHER PUBLICATIONS

U.S. Appl. No. 11/040,040, filed Jan. 21, 2005, entitled "Ink Jet Printhead Having Two Dimensional Shuttle Architecture", by Augustus J. Rogers IV.
U.S. Appl. No. 10/974,768, filed Oct. 28, 2004, entitled "Systems and Methods for Detecting Inkjet Defects" by Jeffrey J. Folkins et al.

* cited by examiner

*Primary Examiner*—Matthew Luu
*Assistant Examiner*—John P Zimmermann
(74) *Attorney, Agent, or Firm*—Maginot, Moore & Beck

(57) ABSTRACT

An ink jet printer has an intermediate transfer drum that rotates past a print head and a downstream transfixing station. The surface of the drum is coated with a release agent. The print head ejects ink droplets onto the coated drum surface to form images thereon. The images are identified for either simplex prints or duplex prints. The transfixing station has separate simplex and duplex operating modes. A movable transfixing roll at the transfixing station is moved into and out of contact with the drum to form a periodic transfixing nip. The nip is formed with separate timing relationships with the approach of the leading and trailing edge of a transported recording medium and the approach of the image on the drum surface, depending upon whether a simplex or duplex print is to be transfixed by the nip.

11 Claims, 8 Drawing Sheets

INK JET PRINTER HAVING MULTIPLE TRANSFIXING MODES

BACKGROUND

An exemplary embodiment of this application relates to an ink jet printer having a transfixing station with multiple transfixing operating modes to enable printing of both simplex and duplex prints with increased overall printing speed. More particularly, the exemplary embodiment relates to an ink jet printer having a print head that ejects ink droplets onto a moving intermediate surface coated with a release agent to produce an ink image thereon and a transfixing station where the printed ink images are transferred onto a recording medium. The transfixing station includes a movable transfixing roll that is moved into and out of contact with the intermediate surface to form a transfixing nip using different timing modes for simplex and duplex prints.

Droplet-on-demand ink jet printing systems eject ink droplets from print head nozzles in response to pressure pulses generated within the print head by either piezoelectric devices or thermal transducers, such as resistors. The ejected ink droplets are propelled to specific locations on a recording medium, commonly referred to as pixels, where each ink droplet forms a spot on the recording medium. The print heads have droplet ejecting nozzles and a plurality of ink containing channels, usually one channel for each nozzle, which interconnect an ink reservoir in the print head with the nozzles.

In a typical piezoelectric ink jet printing system, the pressure pulses that eject liquid ink droplets are produced by applying an electric pulse to the piezoelectric devices, one of which is typically located within each one of the ink channels. Each piezoelectric device is individually addressable to cause it to bend or deform and pressurize the volume of liquid ink in contact therewith. As a voltage pulse is applied to a selected piezoelectric device, a quantity of ink is displaced from the ink channel and a droplet of ink is mechanically ejected from the nozzle associated with each piezoelectric device. Just as in thermal ink jet printing, the ejected droplets are propelled to pixel targets on a recording medium to form image information thereon. The respective channels from which the ink droplets were ejected are refilled by capillary action from an ink supply. For an example of a piezoelectric ink jet printer, refer to U.S. Pat. No. 3,946,398.

The problem of ink drying time and paper cockling are widely recognized issues when printing high coverage areas with aqueous based inks, particularly when printing color images. The problem of drying time and paper cockling is substantially reduced when solid ink printers are used and their print heads eject droplets of melted ink onto the recording medium, where the melted ink droplets solidify immediately. Further improvement in the drying time and cockling problem is obtained when the print head ejects droplets of melted ink onto an intermediate surface, such as, for example, a drum, that has a release agent coating thereon. Once the image is formed on the intermediate surface, the image is then transferred to a recording medium, such as paper. The transfer is generally conducted in a nip formed by the rotating intermediate transfer drum surface and a rotatable pressure roll. The pressure roll may be heated or the recording medium may be pre-heated prior to entry in the transfixing nip. As a sheet of paper is transported through the nip, the fully formed image is transferred from the intermediate transfer drum surface to the sheet of paper and concurrently fixed thereon. This transfer technique of using the combination of heat and pressure at a nip to transfer and fix the image to a recording medium passing through the nip is usually referred to as "transfixing," a well known technology.

Ink jet printers are capable of producing either simplex or duplex prints. By simplex prints, it is meant that the image is on only one side of the recording medium. By contrast, duplex prints have an image on both sides of the recording medium; i.e., the front side and back side of the recording medium. A problem arises, if excessive release oil is present on the transfixing roll, when duplex prints are to be produced. When the first side of a recording medium has an image transfixed to it by the transfixing roll from the intermediate transfer drum, the second or back side of the recording medium may have some oil transferred to it. To complete the duplex print, it is inverted and returned through the transfixing nip to transfix the second image on the back side of the recording medium. Release oil on the side of the recording medium that is to have an image transferred to it would cause reduced transfer efficiency. Therefore, it is one aim of this application to prevent or reduce the application of release oil onto the second side of duplex prints by the transfixing roll at the transfixing station.

Some release agent, such as, for example, silicon oil, is applied to the transfixing pressure roll, as well as the surface of the intermediate transfer drum, because zero oil on the transfixing pressure roll also causes problems. However, only a small amount of release oil is applied to the pressure roll to make sure that a very small oil level is present. Permitting some excess release oil on the transfixing pressure roll to be transferred onto the backside of a simplex print is not a problem, but to do so for a duplex print would cause a duplex transfer latitude problem.

Some conventional solid ink jet printers utilize a process timing that does not allow the transfixing roll to become excessively oiled, but such process timing limits printing speed and thus impacts printer productivity. In one known solid ink jet printer, the transfixing roll is spaced from the intermediate transfer drum and is moved to produce a nip with the intermediate transfer drum only after the intermediate transfer drum is stopped with the top of the image thereon registered at the nip location. Before the nip is formed, the leading edge of a recording medium is transported into the transfixing nip region. Therefore, the transfixing roll engages the leading edge of the recording medium and sandwiches it between the transfixing roll and the intermediate transfer drum, so that the transfixing roll does not engage or contact the oil coated intermediate transfer drum surface when a transfixing nip is formed. Once the nip is formed, the transfixing roll and intermediate transfer drum are rotated to transport the recording medium through the transfixing nip and concomitantly transfixing the image to it. Conversely, the transfixing roll is disengaged from the trailing edge of the recording medium before the recording medium leaves the transfixing nip. Because of this process timing, the transfixing roll never contacts the release oil coated intermediate transfer drum surface, and hence is kept sufficiently dry of oil. Such a timing process sequence is sometimes referred to as a 'stop edge' process. Clearly, stop edge timing for the transfixing roll impacts printer productivity.

To increase the printing speed of the ink jet printer and therefore the printer's productivity, there is a need for faster transfixing of simplex prints, while concurrently preventing excessive release oil from getting on the transfixing roll from the intermediate transfer drum during the transfixing of duplex prints. The prior art has not done this in a cost effective manner. Examples of ink jet printers having an intermediate transfer drum from which printed images are transferred to a recording medium at a transfixing station are disclosed below.

U.S. Pat. No. 5,099,256 discloses a thermal ink jet printer having a translatable multicolor print head and a rotatable intermediate transfer drum with a film forming silicone polymer layer on the outer surface thereof. The drum surface is heated to dehydrate the aqueous based ink droplets deposited thereon from the print head at a first location. The drum is rotated and the dehydrated droplets are transferred from the drum to a recording medium at a transfer station positioned adjacent the drum at a second location.

U.S. patent application Ser. No. 11/040,040, filed Jan. 21, 2005, discloses an ink jet printer having a print head that moves in a two dimensional direction across the surface of a moving intermediate transfer drum or belt. During the printing process, the print head is concurrently moved in a first direction at a velocity equal to the velocity and direction of the intermediate surface and in a second direction that is perpendicular to the first direction. This two dimensional movement of the print head causes the ink droplets to print swaths of information across the intermediate surface that are perpendicular to the first direction. Downstream from the print head, the printed information is transferred and fixed to a recording medium as it is transported through the transfixing nip at the transfixing station.

U.S. patent application Ser. No. 10/974,768, filed Oct. 28, 2004, discloses an ink jet printer having a print head, intermediate transfer drum, and transfixing station. Test images are formed on the interdocument space or blank portions of the intermediate transfer drum by those nozzles of the print head that are most likely to be defective. Thus, the time and ink required to form the test images with nozzles unlikely to be defective is not wasted. The test images printed by the potentially defective nozzles are tested using an image sensor.

U.S. Pat. No. 5,389,958 discloses a method and apparatus for transferring an ink image from an intermediate surface to a final receiving substrate. A layer of sacrificial liquid is applied to the intermediate surface and a phase change ink is deposited on the liquid layer. The ink image is then contact transferred to a final receiving substrate.

U.S. Pat. No. 6,196,675 discloses an apparatus and method for image fusing in an ink jet printing system. The ink image is transferred to a final receiving substrate by passing the substrate through a transfer nip. The substrate and ink image are then passed through a fusing nip that fuses the ink image into the final receiving substrate. Utilizing separate image transfer and image fusing operations allows improved image fusing and faster print speeds.

U.S. Pat. No. 6,494,570 discloses a method for transfer and fusing in an ink jet printer. In the method, an ink image is formed on an intermediate transfer surface, a final receiving substrate is passed through a first nip, a first pressure is exerted on the final receiving substrate in the first nip to transfer the ink image from the intermediate transfer surface to the final receiving substrate, the final receiving substrate is then passed through a second nip where a second pressure and temperature is exerted on the final receiving substrate to fuse the ink image into the final receiving substrate.

SUMMARY

It is an object of an exemplary embodiment of this application to provide an ink jet printer having a transfixing station with multiple transfixing modes, where duplex prints utilizes one timing mode for transfixing images from an intermediate transfer drum to the recording medium and where simplex prints utilizes another timing mode.

In one aspect of the exemplary embodiment, there is provided a method for increasing the printing speed of an ink jet printer capable of producing both simplex and duplex prints by providing multiple transfixing modes, comprising the steps of: providing a print head adjacent a rotatable intermediate transfer drum, so that ink droplets ejected from said print head form ink images on said intermediate transfer drum; maintaining a coating of release agent on said intermediate transfer drum prior to the formation of ink images thereon to assist in a transfer of said ink images therefrom; providing a positionable transfixing roll at a transfixing station; and moving said transfixing roll into and out of a nip forming position with said intermediate transfer drum with different timing sequences to control the transfixing speed of the transfixing station and the transfer of release agent from said intermediate transfer drum onto the transfixing roll.

In one exemplary embodiment, there is provided an ink jet printer having multiple transfixing modes to enable printing of both simplex and duplex prints while increasing the printing speed thereof, comprising: a rotatable intermediate transfer drum having a coating of release agent thereon; a print head adjacent said intermediate transfer drum for ejecting ink droplets therefrom and for forming ink images on said intermediate transfer drum; a transfixing station located adjacent said intermediate transfer drum and downstream from said print head, the transfixing station having a movable transfixing roll adapted for movement towards and away from said intermediate transfer drum in order to form a periodic transfixing nip therewith; a transporting device for delivering a recording medium to said transfixing nip; a controller for controlling the printer operating processes and to determine a timing sequence for forming said transfixing nip relative to entrance therein of said recording medium and ink image on said intermediate transfer drum, whereby the transfer of said release agent on said intermediate transfer drum to said transfixing roll is controlled.

BRIEF DESCRIPTION OF THE DRAWINGS

An exemplary embodiment of this application will now be described, by way of example, with reference to the accompanying drawings, in which like reference numerals refer to like elements, and in which.

DESCRIPTION OF THE PREFERRED EMBODIMENT

Figure 1:
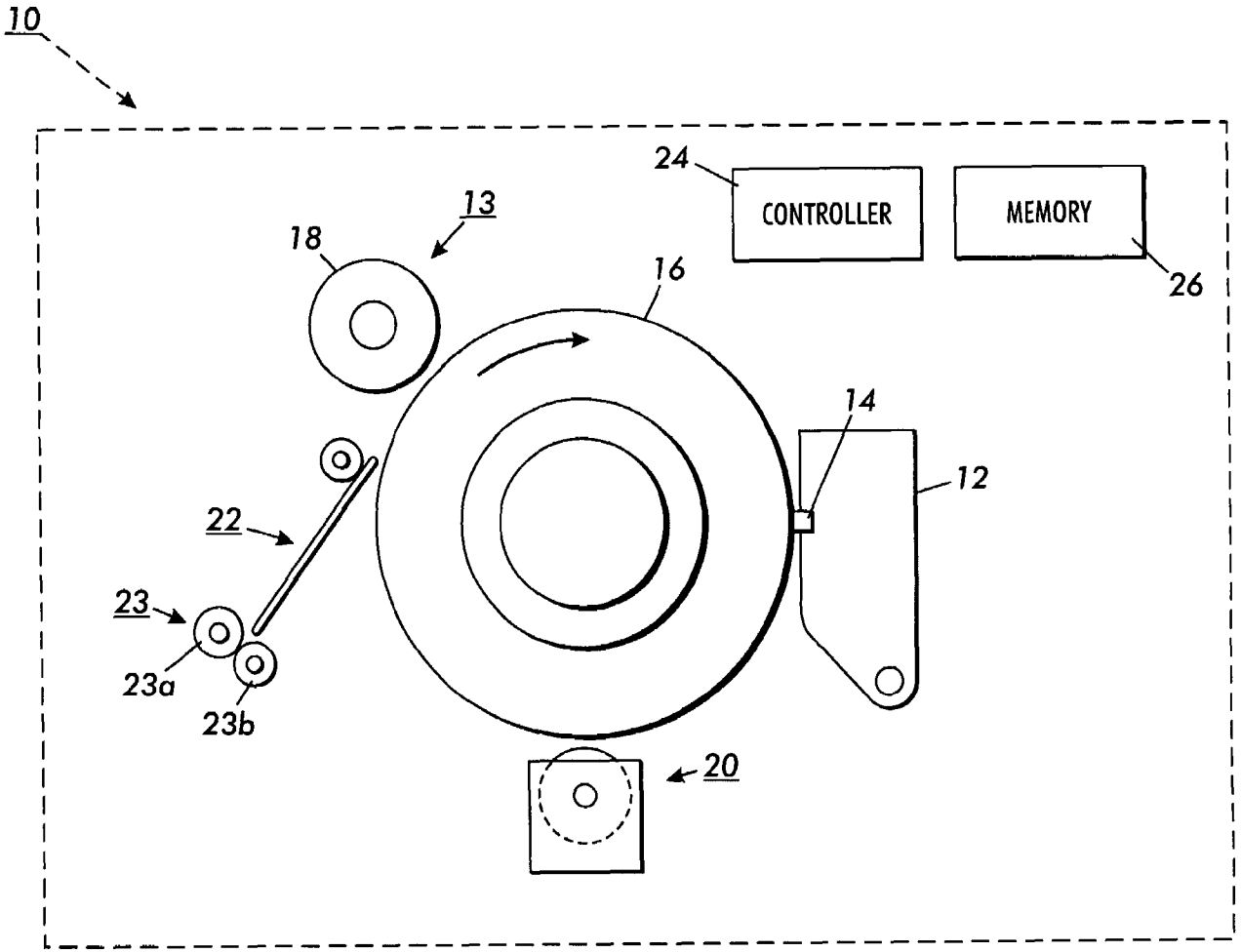
FIG. 1 is a schematic, side elevation view of an ink jet printer having a print head, intermediate transfer drum, and transfixing station with a positionable, nip-forming transfixing roll spaced from the intermediate transfer drum.
Figure 2:
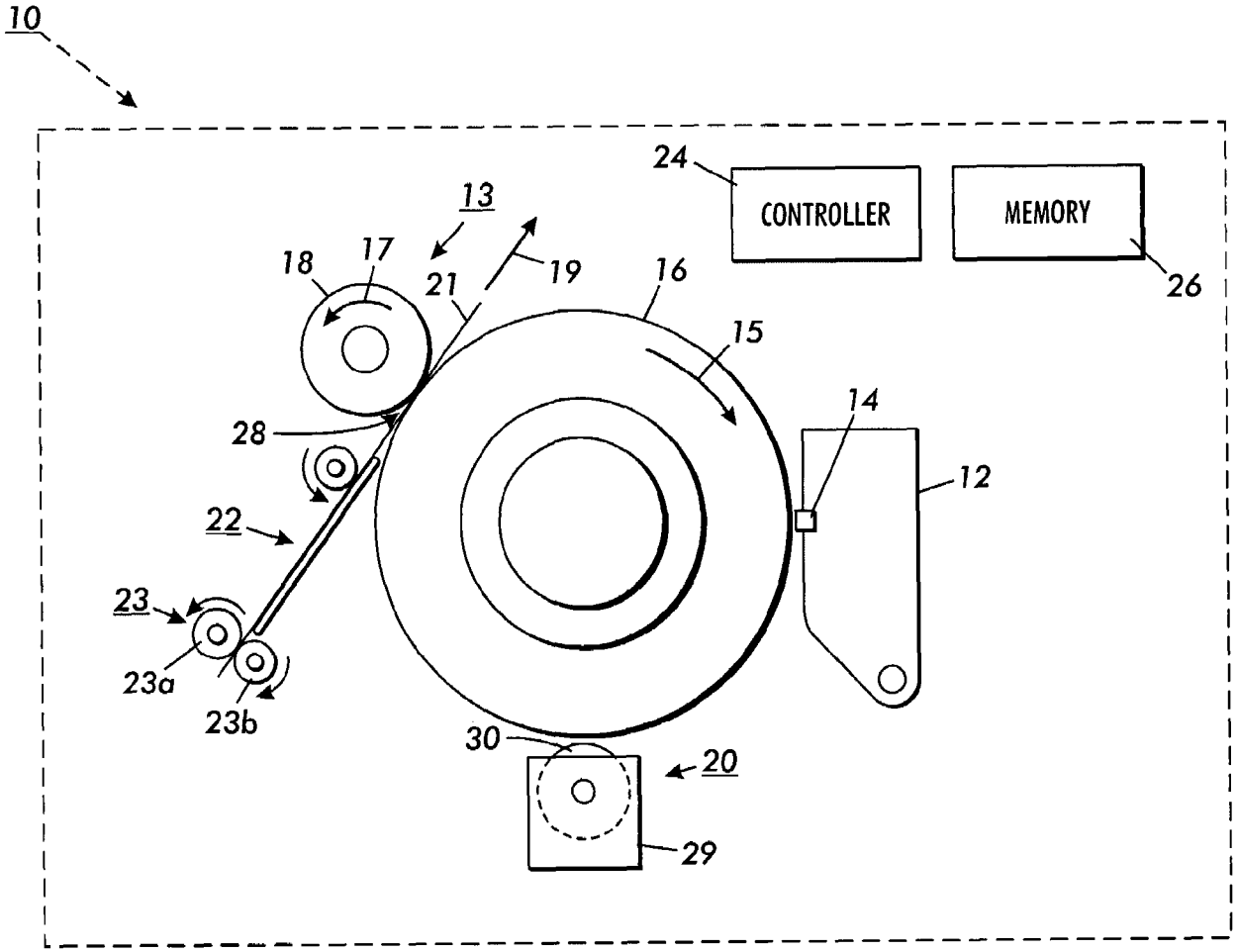
FIG. 2 is similar to FIG. 1, showing the transfixing roll forming a nip with intermediate transfer drum and a recording medium being transported through the nip.

For a general understanding of an ink jet device, such as, for example, a solid ink jet printer in which the features of the exemplary embodiment of this application may be incorporated, reference is made to FIGS. 1 and 2. As shown in FIG. 1, the exemplary ink jet printer 10 includes, in part, a print head carriage 12, one or more print heads 14 mounted on the carriage, an intermediate transfer drum 16, a transfixing station 13 having a movable transfixing roll 18, a release agent applicator 20, a recording medium transport 22 with pre-heater 23, a controller 24 and a memory 26.

The memory 26 may include, for example, any appropriate combination of alterable, volatile or non-volatile memory, or non-alterable or fixed memory. The alterable memory, whether volatile or non-volatile, can be implemented using any one or more of static or dynamic RAM, a floppy disk and disk drive, a writeable or re-writeable optical disk and disk drive, a hard drive, flash memory or the like. Similarly, the non-alterable or fixed memory can be implemented using any one or more of ROM, PROM, EPROM, EEPROM, an optical ROM, such as CD-ROM or DVD-ROM disk, and disk drive or the like. It should also be appreciated that the controller 24 and/or memory 26 may be a combination of a number of component controllers or memories all or part of which may be located outside the printer 10.

When configured to print an ink image on the intermediate transfer drum 16, as shown in FIG. 1, the one or more print heads 14, under control of the controller 24, is positioned in close proximity to the intermediate transfer drum. As a result, under control of the controller 24, the print heads 14 eject ink droplets onto the intermediate transfer drum to form ink images thereon. The print heads each receive an ink ejection signal from the controller 24 and, in response thereto, eject ink droplets onto the intermediate transfer drum 16. Ink droplets are ejected until the whole image is formed on the intermediate transfer drum 16. While ink droplets are being deposited on the intermediate transfer drum, the transfixing roll 18 at the transfixing station 13 is not in contact with the intermediate transfer drum 16.

According to one exemplary embodiment of this application, a single image may cover the entire surface of the intermediate transfer drum 16 (single pitch). According to various other exemplary embodiments, a plurality of images may be deposited on the intermediate transfer drum 16 (multi-pitch). Furthermore, the images may be deposited in a single pass (single pass method), or the images may be deposited in a plurality of passes (multi-pass method).

When images are deposited on the intermediate transfer drum 16 according to the multi-pass method, under control of the controller 24, a portion of the image is deposited by the print heads 14 during a first rotation of the intermediate transfer drum 16. Then during one or more subsequent rotations of the intermediate transfer drum 16, under control of the controller 24, the print heads deposit the remaining portions of the image on top of the first portion printed. Thus, the complete image is printed one portion at a time on top of each other during each rotation of the intermediate transfer drum 16.

For example, one type of a multi-pass printing architecture is used to accumulate images from multiple color separations. On each rotation of the intermediate transfer drum 16, ink droplets for one of the color separations are ejected from the print heads and deposited on the surface of the intermediate transfer drum 16 until the last color separation is deposited to complete the image. Another type of multi-pass printing architecture is used to accumulate images from multiple swaths of ink droplets ejected from the print heads. On each rotation of the intermediate transfer drum 16, ink droplets for one of the swaths (each containing a combination of all of the colors) is applied to the surface of the intermediate transfer drum 16 until the last swath is applied to complete the ink image. Both of these examples of multi-pass architectures perform what is commonly known as "page printing." Each image comprised of the various component images represents a full sheet of information worth of ink droplets which, as described below, is then transferred from the intermediate transfer drum 16 to a recording medium.

In a multi-pitch printing architecture, the surface of the intermediate transfer drum is partitioned into multiple segments, each segment including a full page image (i.e., a single pitch) and an inter-document zone or space. For example, a two pitch intermediate transfer drum 16 is capable of containing two images, each corresponding to a single sheet of recording medium, during a revolution of the intermediate transfer drum 16. Likewise, for example, a three pitch intermediate transfer drum is capable of containing three images, each corresponding to a single sheet of recording medium, during a pass or revolution of the intermediate transfer drum 16.

Once an image or images have been printed on the intermediate transfer drum 16, according to either of the single pass method of multi-pass method and under control of the controller 24, the exemplary ink jet printer 10 converts to a configuration for transferring and fixing the image or images at the transfixing station 13 from the intermediate transfer drum 16 onto a recording medium 21. According to this configuration, as shown in FIG. 2, a sheet of recording medium 21 is transported by transport 22, under control of the controller 24, to a position adjacent the transfixing station 13 and then through a nip 28 formed between the movable or positionable transfixing roll 18 and intermediate transfer drum 16, as indicated by arrow 19. The transfixing roll 18 applies pressure against the back side of the recording medium 21 in order to press the front side of the recording medium 21 against the intermediate transfer drum 16. Although the transfixing roll 18 may also be heated, in this exemplary embodiment, it is not. Instead, the transport 22 contains a pre-heater 23 for the recording medium 21, comprising a pair of heated rolls 23*a*, 23*b*. The pre-heater provides the necessary heat to the recording medium 21 for subsequent aid in transfixing the image thereto, thus simplifying the design of the transfixing roll. The pressure created by the transfixing roll 18 on the back side of the heated recording medium 21 facilitates the transfixing (transfer and fusing) of the image from the intermediate transfer drum 16 onto the recording medium 21.

The rotation or rolling of both the intermediate transfer drum 16 and transfixing roll 18, as shown by arrows 15, 17, respectively, not only transfix the images onto the recording medium 21, but also assist in transporting the recording medium 21 through the nip 28 formed between them. This transporting assistance by the rolling intermediate transfer drum 16 and transfixing roll 18 is especially needed after the trailing edge of the recording medium 21 leaves the recording medium transport 22.

Once an image is transferred from the intermediate transfer drum 16 and transfixed to a recording medium 21, the transfixing roll 18 is moved away from the intermediate transfer drum 16 and the intermediate transfer drum 16 continues to rotate and, under the control of the controller 24, any residual ink left on the intermediate transfer drum 16 is removed by well known drum maintenance procedures at a maintenance station, not shown. Also, periodic applications of release agent, such as, for example, silicone oil, are applied to the surface of the intermediate transfer drum by the release agent applicator 20, under control of the controller 24, prior to subsequent printing of images on the intermediate transfer drum 16 by the print heads 14. Typically, the release agent applicator includes a container 29 of release agent (not shown) and a resilient porous roll 30 rotatably mounted in the container and in contact with the release agent. The porous roll 30 is periodically moved into temporary contact with the rotating intermediate transfer drum 16 to coat the surface thereof as needed by the controller 24.

Since a predetermined amount of release agent is necessary for efficient transfixing of images onto a recording medium 21, a small amount is applied to the transfixing roll 18 about every 50 prints produced by the printer to make sure that the required small level of release agent is present thereon. Any suitable means (not shown) for applying the release agent to the transfixing roll will suffice, such as, for example, a resilient foam roller. Permitting some of the release agent from the transfixing roll 18 to get transferred onto the back side of a simplex print is not a problem, as indicated earlier. Therefore, this intentional application of release agent on the transfixing roll 18 is always done in a printing job with a known number of remaining simplex prints. By passing simplex prints through the transfixing nip at the transfixing station 13, after an intentional application of release agent to the transfixing roll 18, the release agent level thereon is reduced to acceptable limits for subsequent duplex prints. In other words, the transfixing roll 18 is cleaned off by the back side of the simplex prints, where release agent is not a problem.

Figure 3:
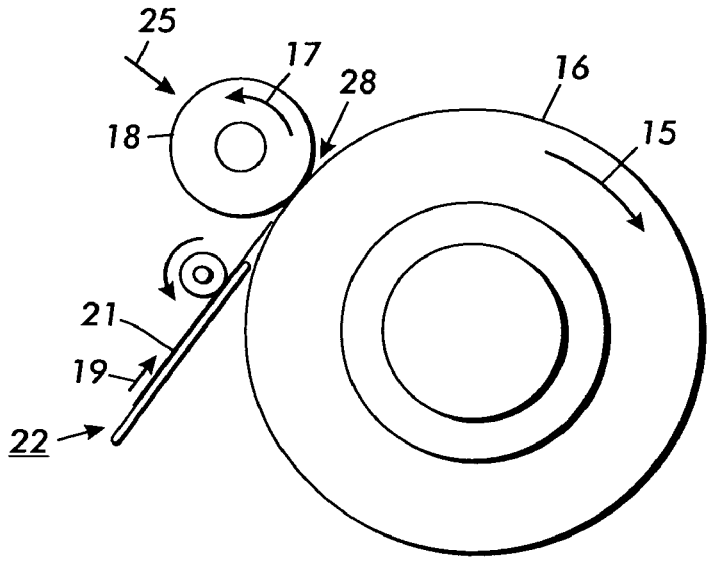
FIG. 3 shows a timing mode for the transfixing roll in which the transfixing roll forms a nip with a rotating intermediate transfer drum prior to the entry of the leading edge of a recording medium.

Customers are generally more concerned about the printing speed for simplex printing by ink jet printers, but want the ink jet printers to be capable of printing duplex prints as well. However, it is necessary that the duplex prints have the same high quality as simplex prints. Referring to FIG. 3, improved printing speed for simplex prints may be obtained by moving the transfixing roll 18 into contact with the surface of the intermediate transfer drum 16, as indicated by arrow 25, to form nip 28 therewith, while the intermediate transfer drum 16 is being rotated in the direction of arrow 15. The nip 28 is formed immediately before the top edge of the image (not shown), deposited on the rotating intermediate transfer drum 16 by the print heads 14, reaches the nip. Concurrently, the controller 24 actuates the recording medium transport 22 to move the recording medium 21 towards the transfixing nip 28 in a timed relation to the formation of the nip. In this simplex timing mode, the nip 28 is formed just prior to the entry of the leading edge of the recording medium 21. Such timing of the recording medium 21, with regard to the formation of the transfixing nip 28 prior to entry of the recording medium 21 and while the intermediate transfer drum 16 is being rotated, is sometimes referred to as "load on the fly."

Figure 4:
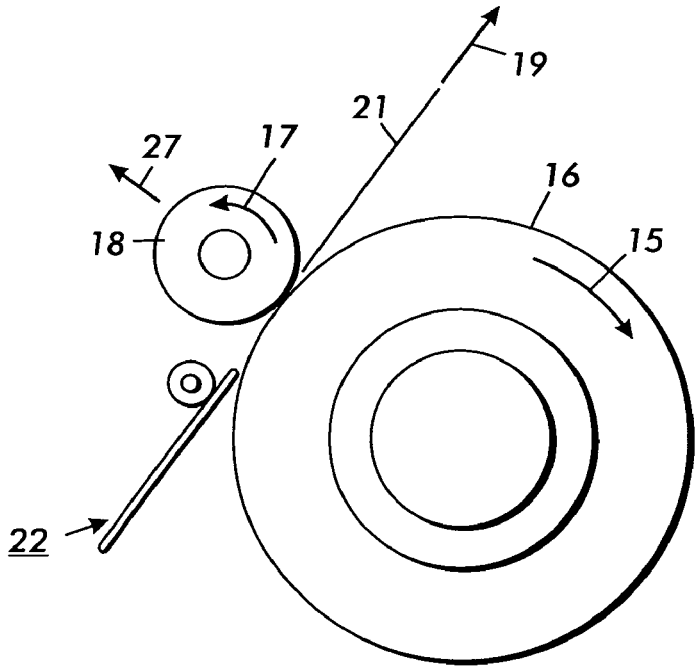
FIG. 4 shows the transfixing roll of FIG. 3 being disengaged from the nip forming position after the exit of the trailing edge of the recording medium from the nip.

Upon contact with the rotating intermediate transfer drum 16, the transfixing roll 18 is also rotated, as shown by arrows 15, 17. Because the leading edge of the recording medium 21 enters the nip 28 just after it has been formed, some release agent (not shown) that covers the surface of the intermediate transfer drum 16 is transferred to a surface portion of the transfixing roll 18. Some release agent, such as silicone oil, is placed on the back side of the recording medium 21 as it is transported through the transfixing nip in direction of arrow 19 to produce the simplex print. By back side, it is meant the side opposite to the one having the image transfixed thereto. As soon as the trailing edge of the recording medium 21 exits from the nip 28, the transfixing roll 18 is moved in the direction of arrow 27 from contact with the intermediate transfer drum 16 and returned to a position spaced therefrom, as shown in FIG. 4.

However, a complicating problem is encountered with the simplex timing mode when a duplex print is to be printed following a simplex print produce by a transfixing nip using the simplex timing mode. The problem is that the release agent, such as oil, that is required by the intermediate transfer drum 16 to facilitate image transfer therefrom, has been transferred to the transfixing roll 18 in amounts unacceptable for quality duplex prints. Thus, the images for the back side of the duplex prints will encounter release agent placed on the recording medium 21 back side when the first or front side has received its image.

Figure 5:
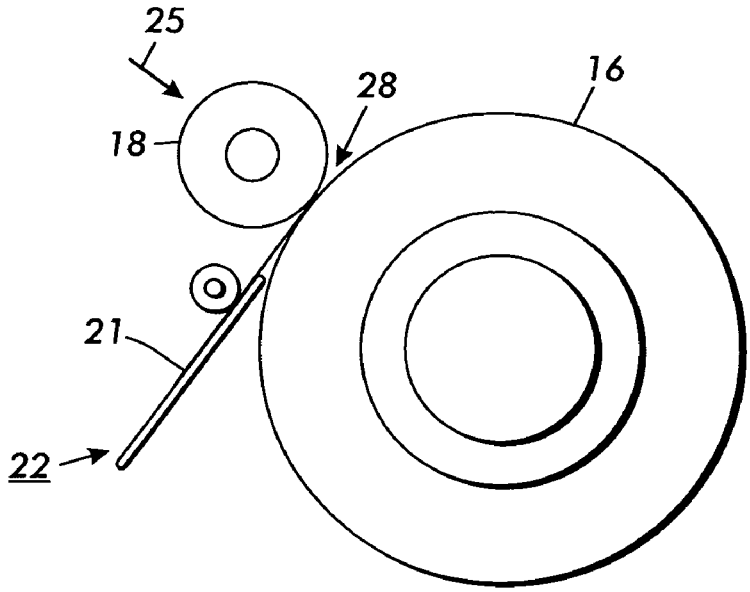
FIG. 5 shows a timing mode for the transfixing roll in which the intermediate transfer drum is stopped and a transfixing roll moved into contact with the leading edge of a recording medium to form a nip without first contacting the intermediate transfer drum.
Figure 6:
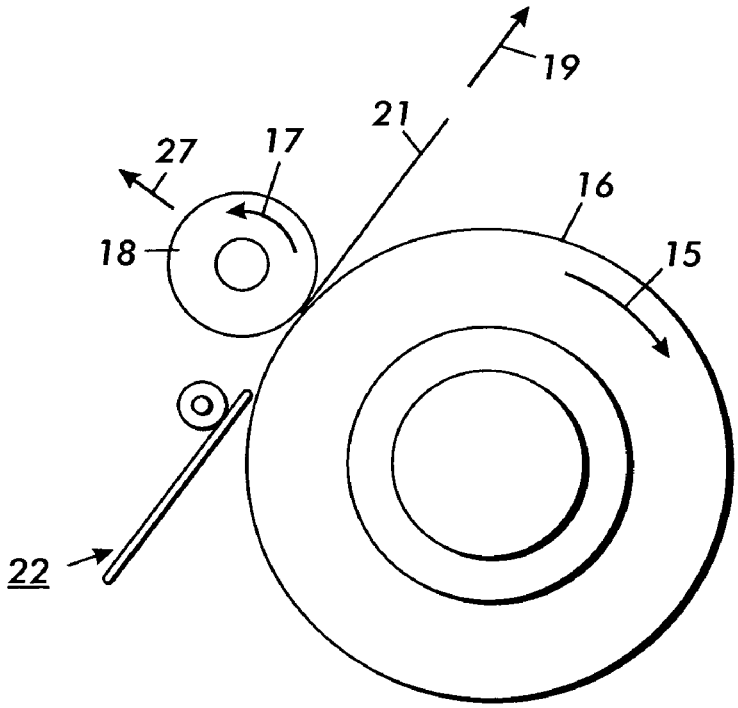
FIG. 6 shows the transfixing roll of FIG. 5 being disengaged from the nip forming position prior to the exit of the trailing edge of the recording medium from the nip.

In FIGS. 5 and 6, a duplex timing mode is provided which does not transfer release agent to the transfixing roll 18, thereby providing high quality duplex prints. Referring to FIG. 5, the rotation of intermediate transfer drum 16 is stopped with the top edge of the front side image (not shown) on the intermediate transfer drum 16 being registered at the location where the transfixing nip 28 will be subsequently formed. The recording medium 21 is transported by the transport 22 and stopped at a location with its leading edge residing in the place where the transfixing nip 28 will be formed. Next, the transfixing roll 18 is moved in the direction of arrow 25 toward the intermediate transfer drum 16 to form the transfixing nip 28 and capture the leading edge of the recording medium 21. Thus, the formation of the nip 28 sandwiches the leading edge of the recording medium 21 between the intermediate transfer drum 16 and the transfixing roll 18. Therefore, the transfixing roll 18 does not contact the surface of the intermediate transfer drum 16, so that the transfixing roll cannot have any release agent transferred to it from the intermediate transfer drum 16 when the nip is formed.

In FIG. 6, the intermediate transfer drum 16 and transfixing roll 18 are then rotated in the direction of arrows 15, 17, respectively, to assist in transporting the recording medium 21 through the nip, while concurrently transfixing the first side image from the intermediate transfer drum 16 onto the recording medium 21 as it passes through the transfixing nip 28. Prior to the trailing edge of the recording medium 21 exiting from the nip 28, the transfixing roll 18 is withdrawn in the direction of arrow 27 from the intermediate transfer drum 16, so that release agent still cannot contact the transfixing roll 18. Such a duplex timing mode is sometimes referred to as a "stop edge" timing process. Once the front side image of the duplex print has been transfixed to the front side of the recording medium 21, the recording medium 21 is inverted by well know means, so that a back side image can be transfixed to the back side of the recording medium 21 to complete the duplex print. The inverted recording medium 21 is returned to the transfixing nip 28 and the above-described duplex timing mode of FIGS. 5 and 6 is repeated to transfix the back side image from the intermediate transfer drum 16 to the back side of the recording medium 21 and complete the duplex print.

In an ink jet printer having the capability of ejecting ink droplets at about 40 kHz and of transferring the image from the intermediate transfer drum 16 in a transfixing nip at about 30 inches per second (ips), transfixing with a Load on the Fly type of timing process may achieve a printer speed of 40 pages per minute (ppm). In contrast, the Stop Edge timing process would achieve only about 35 ppm. Thus, the Stop Edge timing is slower and the Load on the Fly timing is faster. However, the Load on the Fly timing process transfers release agent to the transfixing roll 18 and the Stop Edge timing process does not. A further complicating factor is that there is no way to know whether the next printing job will be simplex or duplex.

Figure 7:
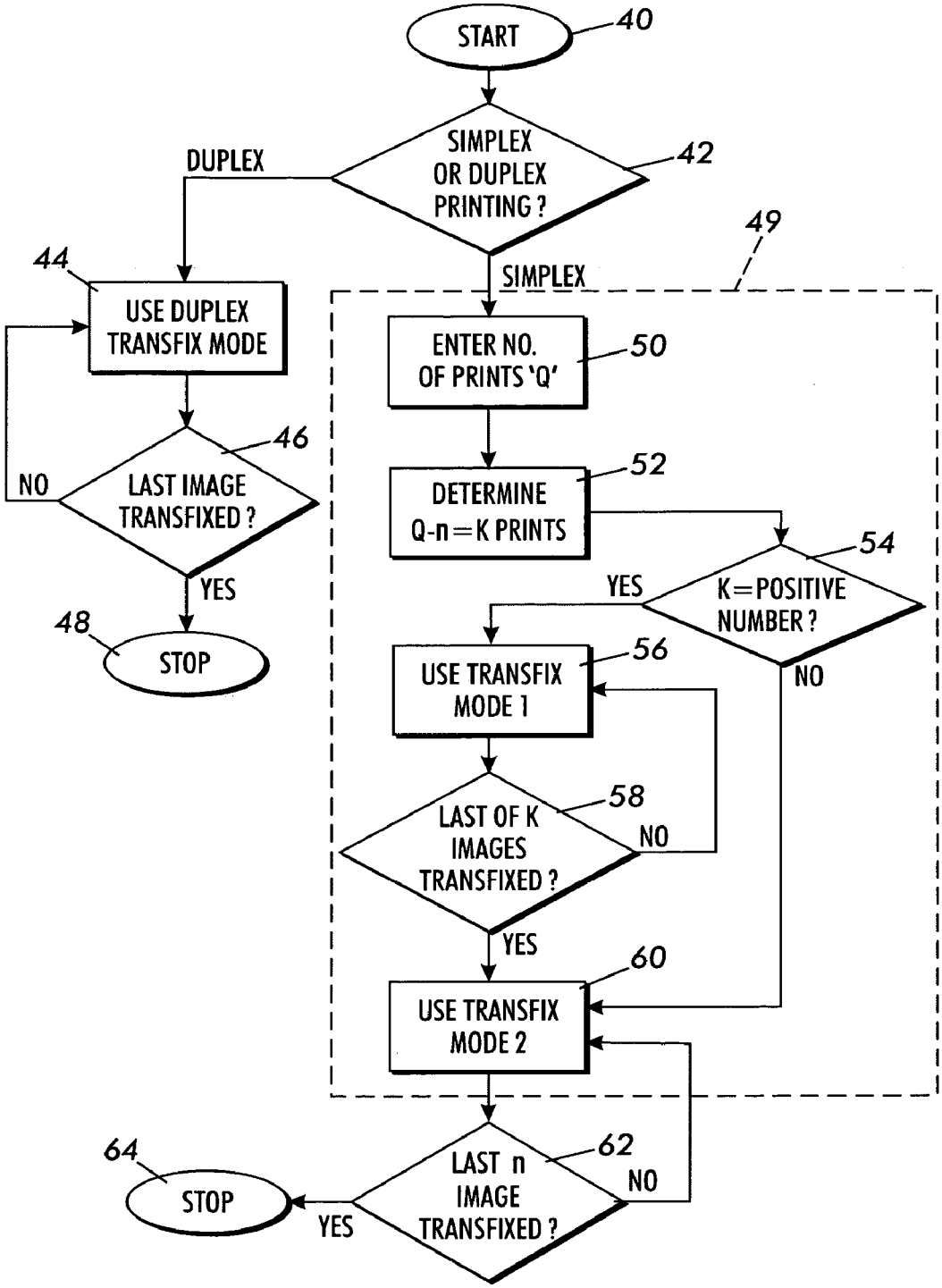
FIG. 7 shows an exemplary method for transfixing images onto a recording medium from an intermediate transfer drum for either simplex or duplex prints by an ink jet printer having multiple transfixing modes.

In FIG. 7, an exemplary embodiment of a method for increasing the overall speed of an ink jet printer is described that is capable of producing both high quality simplex and duplex prints by providing a transfixing station 13 for the printer with multiple transfixing modes in order to control the level of release agent on the transfixing roll 18. When a user or customer initiates a printing job, operation of the method begins at step 40. Then, in step 42, the controller 24 checks whether the printing job is for simplex or duplex prints. If the prints are to be duplex, the controller directs that the duplex transfixing mode be used by the transfixing station 13 at step 44. In step 46, the controller checks, after each duplex print has been made, if the duplex print that has been produced is the last duplex print of the current printing job to be made. If the last duplex print to be made has been accomplished, the method is stopped at step 48. If the last duplex print has not been produced, the printer is directed back to step 44. The steps in the duplex transfixing mode is described with reference to FIG. 8, discussed below.

Continuing with FIG. 7, if the prints are to be simplex, the controller 24 directs that a simpex transfixing mode 49 be used by the transfixing station 13. The controller 24 then enters the quantity or number (Q) of simplex prints to be made in memory 26 at step 50. To make sure there is no undesired amount of release agent on the transfixing roll 18 of transfixing station 13, after the simplex prints are produced, a predetermined number (n) of simplex prints that are produced last must use a transfixing mode similar to the one used in making duplex prints. It has been determined that n should be 1 to 4 simplex prints, and preferably 1, where n is the number of simplex prints necessary to clean enough of the release agent from the transfixing roll 18 to allow adequate duplex printing process latitude. For example, if Q is only a single simplex print, then Q−n=K is zero, for there can be no negative number of K prints. When K=zero, n is made equal to Q. Thus, when the K number of simplex prints is zero and n is made equal to Q, a transfixing mode similar to the duplex transfixing mode is used. Accordingly, when Q−n=K and K is a positive number greater than zero, the number K of simplex prints is produced by a simplex transfixing mode, followed by the last n number of simplex prints being produced by a transfixing mode similar to the duplex transfixing mode. Therefore, the n number of simplex prints is that number necessary to clean off the transfixing roll 18 and prepare the printer for a possible subsequent duplex printing job.

After Q number of simplex prints for the current printing job has been stored in memory 26, the controller evaluates the equation Q−n=K for the number of K prints at step 52. In step 54, K is checked to see if it is a positive number greater than zero. If K is a positive number greater than zero, the controller directs that the transfix mode 1 be used by the transfixing station 13 at step 56. If K is not a positive number greater than zero, the controller directs the transfix mode 2 be used by the transfixing station 13 at step 60. If K prints are to be produced, the controller checks to see if the last K print has been transfixed at step 58, after each simplex image has been transfixed to a recording medium 21 to produce a simplex print. If the last K print has not been transfixed, the transfixing station 13 of the printer is directed back to step 56. If the last K print has been transfixed, the controller directs that the transfix mode 2 be used by the transfixing station 13 for n prints at step 60. Each of the n simplex prints that are produced by the transfix mode 2 at the transfixing station 13 is checked at step 62 for the last n print. If the last n print has not been transfixed, the transfixing station 13 is directed back to step 60. Once the last n print has been produced, the printer is directed to stop at step 64.

Figure 8:
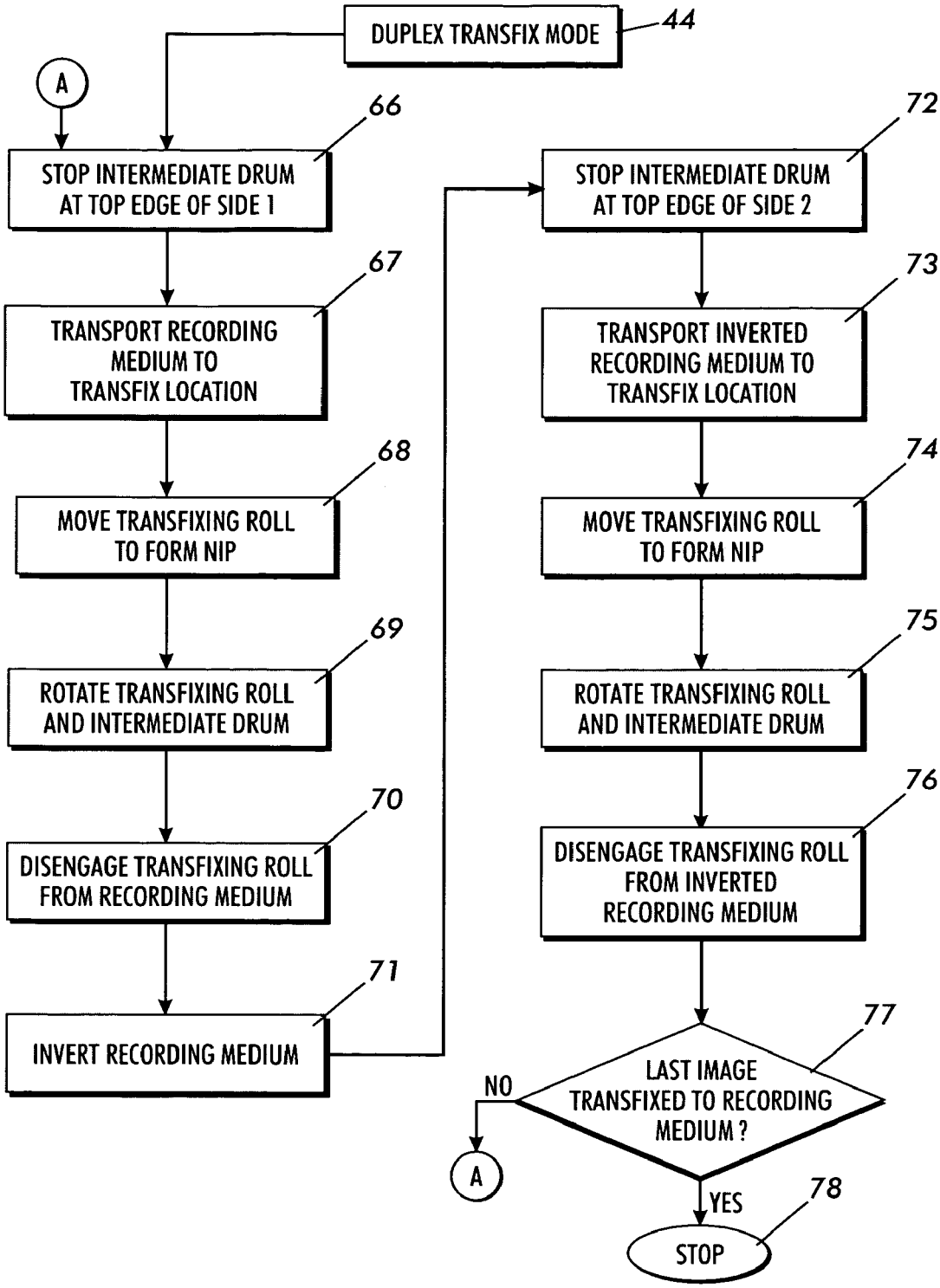
FIG. 8 shows an exemplary method for transfixing images onto a recording medium to form duplex prints in accordance with the method shown in FIG. 7.

In FIG. 8, the steps in the method for the duplex transfixing mode referred to in step 44 of FIG. 7 is depicted, the steps being under the control of the controller 24. First, in step 66, the rotation of the intermediate transfer drum 16 is stopped when the top edge of the first side or side 1 of the duplex image on the intermediate transfer drum 16 reaches the transfixing location at the transfixing station 13. In step 67, the transport 22 advances and registers the leading edge of the recording medium 21 with the transfixing location at the transfixing station 13, while concurrently heating the recording medium 21 by the pre-heater 23. The transfixing roll 18 of the transfixing station 13 is moved toward the intermediate transfer drum 16 to form a transfixing nip 28 and engage the leading edge of the recording medium 21 at step 68. When the nip is formed, the leading edge of the recording medium 21 is sandwiched between the transfixing roll 18 and the intermediate transfer drum 16, so that the transfixing roll 18 does not contact the intermediate transfer drum 16 and the release agent on the intermediate transfer drum 16 cannot be transferred to the transfixing roll 18. Next, at step 69, the intermediate transfer drum 16 and transfixing roll 18 are rotated to transport the recording medium 21 through the nip, so that the side 1 image on the intermediate transfer drum 16 is transfixed thereto. Before the trailing edge of the recording medium 21 exits the nip, the transfixing roll 18 is removed from contact therewith, thus disengaging from the nip at step 70. The transfixing roll 18 does not contact the intermediate transfer drum 16 after the recording medium 21 passes through the nip, so that no release agent can be transferred to the transfixing roll 18. The recording medium 21, having the side 1 image transfixed thereto, is inverted at step 71 and is readied for the receipt of the side 2 image on the other side thereof to complete the duplex print.

With continued reference to FIG. 8, the rotation of the intermediate transfer drum 16 is stopped at step 72, when the top edge of the back side or side 2 of the duplex image on the intermediate transfer drum 16 reaches the transfixing location at the transfixing station 13. At step 73, the inverted recording medium 21 is transported to the transfixing station 13 and the leading edge thereof is registered at the transfixing location in the transfixing station 13. At step 74, the transfixing roll 18 of the transfixing station 13 is moved toward the intermediate transfer drum 16 to form the transfixing nip 28 therewith and engage the leading edge of the inverted recording medium 21 that is registered at the transfixing location. Thus, the leading edge of the recording medium 21 is sandwiched in the nip between the transfixing roll 18 and the intermediate transfer drum 16. Again, the transfixing roll does not contact the intermediate transfer drum 16, so that no release agent can be transferred thereto. The intermediate transfer drum 16 and transfixing roll 18 are rotated at step 75 to transport the inverted recording medium 21 through the nip and transfix the side 2 image from the intermediate transfer drum 16 onto the back side of the recording medium 21, which now confronts the intermediate transfer drum 16. Before the trailing edge of the inverted recording medium 21 exits the nip, the transfixing roll 18 is removed from contact therewith, thus disengaging from the nip at step 76. Since the transfixing roll 18 does not contact the intermediate transfer drum 16 after the inverted recording medium 21 passes through the nip, no release agent can be transferred to the transfixing roll 18. Once the first duplex print has been produced with the transfixing of the side 2 image onto the recording medium 21 and for each subsequent duplex print, the controller checks if this is the last duplex print to be produced at step 77. If the last duplex print is made, the printer is directed to stop at step 78. If more duplex prints are to be printed, the transfixing station 13 is directed back to step 66, as indicated by the circled A.

Figure 9:
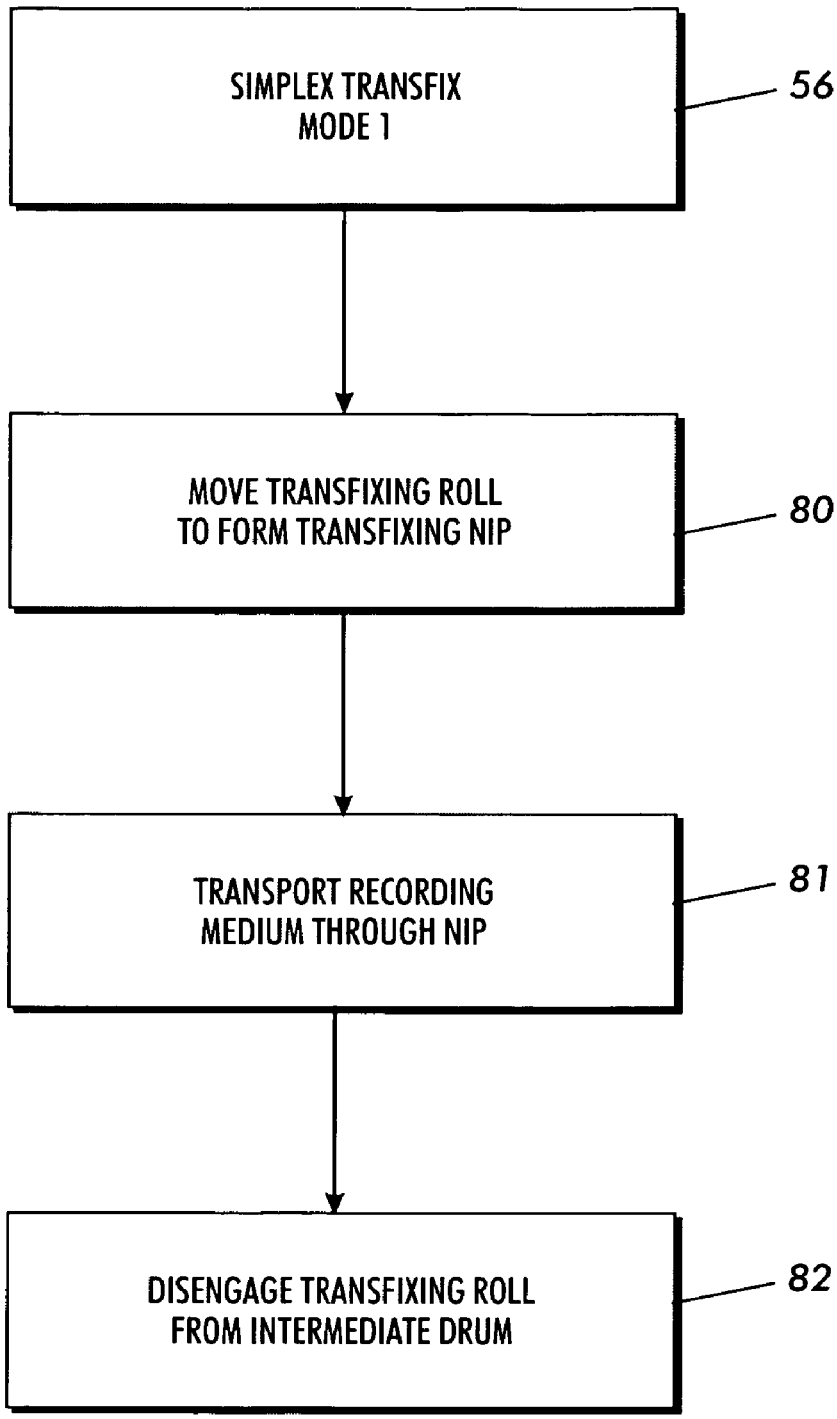
FIGS. 9 and 10 show an exemplary method for transfixing images onto a recording medium to form simplex prints in accordance with the method shown in FIG. 7.

In FIG. 9, the steps in the method for the simplex transfixing mode 1 referred to as step 56 of FIG. 7 is delineated, the steps being under the control of the controller 24. In step 80, the transfixing roll 18 is moved towards the rotating intermediate transfer drum 16 with a timing such that a transfixing nip 28 is formed therewith as the top edge of each simplex image on intermediate transfer drum 16 approaches the transfixing nip at the transfixing station 13. Therefore, the nip 28 is formed prior to the arrival of the top edge of the simplex image. As soon as the nip 28 is formed, the transfixing roll 18 is also rotated in a direction opposite to the intermediate transfer drum 16 as shown by arrows 15, 17 in FIG. 3. In step 81, the recording medium 21 is transported to the transfixing nip 28 in a timed relationship therewith such that the leading edge of each recording medium 21 arrives at the nip after the nip has been formed by the rotating transfixing roll 18 and rotating intermediate transfer drum 16. Thus, as the recording medium 21 is transported through the nip, the simplex image on the intermediate transfer drum 16 is transfixed to the recording medium 21 without interruption of the rotation of the intermediate transfer drum 16 and transfixing roll 18. As soon as the trailing edge of the recording medium 21 has passed through the nip, the transfixing roll 18 is disengaged and withdrawn from the intermediate transfer drum 16 at step 82. Though some release agent may be transferred to the transfixing roll 18 during the simplex transfixing mode 1, the release agent is removed therefrom on the back side of subsequently printed n simplex prints where such release agent is not a problem.

Figure 10:
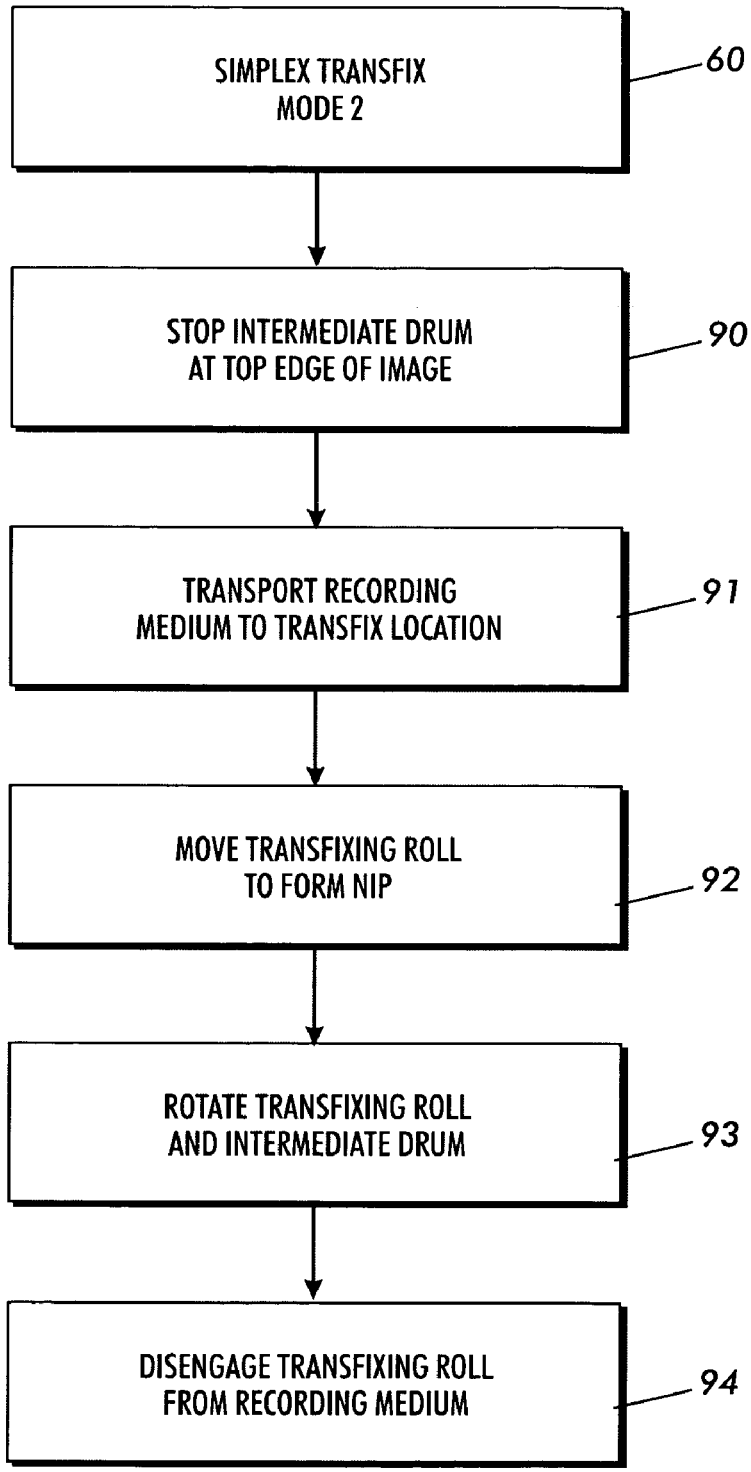

In FIG. 10, the steps comprised within the method for the simplex transfixing mode 2, referred to as step 60 in FIG. 7, are delineated. These steps in transfixing mode 2 are also under the control of the controller 24. Similar to the duplex transfixing mode of FIG. 8, the intermediate transfer drum 16 is stopped when the top edge of the simplex image thereon reaches the subsequently to be formed nip region at the transfixing station 13 at step 90. Next, at step 91, the recording medium 21 is transported to the nip region and the leading edge thereof is registered with the simplex image on the intermediate transfer drum 16. Then, the transfixing roll 18 is moved towards the intermediate transfer drum 16 to engage the leading edge of the recording medium 21 and to form concurrently the transfixing nip 28 at step 92. When the nip is formed, the leading edge of the recording medium 21 for the first of the n simplex prints is sandwiched between the transfixing roll 18 and the intermediate transfer drum 16, so that the transfixing roll 18 does not directly contact the intermediate transfer drum 16. At step 93, the intermediate transfer drum 16 and transfixing roll 18 are rotated to assist both in the transporting of the recording medium 21 through the nip and to transfix the simplex image onto the recording medium 21. Before the trailing edge of the recording medium 21 exits from the nip, the transfixing roll 18 is withdrawn and disengaged from the nip relationship with the intermediate transfer drum 16 at step 94. With the timing process of the simplex transfixing mode 2, additional release agent cannot be transferred to the transfixing roll 18 during completion of the simplex printing job. Further, any release agent previously transferred to the transfixing roll 18, during the simplex transfixing mode 1 of step 56, is cleaned off on the back side of the n number of simplex prints required to complete the simplex printing job.

The exemplary embodiment of the method described above provides at least two transfixing modes for the transfixing station 13 of an ink jet printer. This method allows the bulk of the simplex prints in each printing job to be printed at the fastest speed possible. In addition, this method always cleans the transfixing roll 18 in the transfixing station 13 at the end of each simplex printing job for the possibility that the next printing job will be for duplex prints. As long as the cleaning number of simplex prints n is small, the over all printer printing speed for simplex prints is not significantly impacted, since printer speeds are only reasonably calculated for at least a minutes worth of printing; i.e., 16-50 pages.

It will be appreciated that various of the above-disclosed and other features and functions, or alternatives thereof, may by desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A method for increasing the printing speed of an ink jet printer capable of producing both simplex and duplex prints by providing multiple transfixing modes, comprising:

operating a print head adjacent a rotatable intermediate transfer drum to eject ink droplets from said print head to form ink images on said intermediate transfer drum;

maintaining a coating of release agent on said intermediate transfer drum prior to the formation of ink images thereon to assist in a transfer of said ink images therefrom;

selectively rotating a positionable transfixing roll at a transfixing station; and configuring a controller and a memory to control said printer process operations and to move said transfixing roll into and out of a nip forming position with said intermediate transfer drum with different timing sequences to control both the transfixing speed of the transfixing station and the transfer of release agent from said intermediate transfer drum onto said transfixing roll, the movement of said transfixing roll with different timing sequences comprising:

identifying whether a current printing job to be done by said printer is for simplex or duplex prints;

operating the transfixing station in a duplex transfixing mode for duplex prints; and operating the transfixing station in a simplex transfixing mode for simplex prints by:

entering a number Q of simplex prints to be printed;

selecting n number of simplex prints necessary to clean release agent from the transfixing roll;

solving equation Q−n=K, where K is zero when Q is equal or less than n and where n=Q when K is zero;

operating the transfixing station in a simplex transfixing mode 1 for simplex prints when K is a positive number;

checking for a last print of K simplex prints;

operating the transfixing station in a simplex transfixing mode 2 upon completion of K simplex prints or when K is zero; and stopping the printer when a last print of n simplex prints have been produced.

2. The method as claimed in claim 1, wherein the operation of the transfixing station in a duplex transfixing mode comprises:

stopping the intermediate transfer drum when a top edge of side 1 of a duplex image on said intermediate transfer drum reaches the transfixing station;

transporting a recording medium to the transfixing station;

registering a leading edge of said recording medium having a front side and a back side with the top edge of side 1 of said duplex image on the intermediate transfer drum;

moving the transfixing roll in said transfixing station to contact said leading edge of said recording medium and to form a transfixing nip with said intermediate transfer drum;

rotating said intermediate transfer drum and transfixing roll to transport the recording medium through said transfixing nip to transfix said side 1 image onto said front side of the recording medium;

disengaging the transfixing roll from the trailing edge of the recording medium prior to exit from said transfixing nip;

inverting said recording medium; and repeating the stopping of the intermediate transfer drum and the registration of the leading edge of the recording medium with side 2 of the duplex image on the intermediate transfer drum prior to transfixing side 2 of said duplex image onto the back side of said recording medium to complete a duplex print by said printer.

3. The method as claimed in claim 1, wherein the simplex transfixing mode 1 comprises:

moving the transfixing roll towards said intermediate transfer drum while said intermediate transfer drum is rotating to form a transfixing nip therewith;

transporting the leading edge of said recording medium into and through said transfixing nip as the top edge of the ink image on said intermediate transfer drum approaches said transfixing nip; and disengaging said transfixing roll from said intermediate transfer drum after passing of the trailing edge of each recording medium.

4. The method as claimed in claim 1, wherein the simplex transfixing mode 2 comprises:

stopping said intermediate transfer drum when the top edge of the simplex image thereon reaches the transfixing station;

transporting a recording medium to the transfixing station;

registering a leading edge of said recording medium with the top edge of said simplex image;

moving the transfixing roll in said transfixing station to contact said leading edge of said recording medium and to form a transfixing nip with said intermediate transfer drum;

rotating said intermediate transfer drum and transfixing roll to transport said recording medium through said transfixing nip and to transfix said image onto said recording medium; and disengaging the transfixing roll from the trailing edge of said recording medium prior to exit of said trailing edge from said transfixing nip.

5. A method for increasing the printing speed of an ink jet printer capable of producing both simplex and duplex prints with equal print quality by having multiple transfixing modes, comprising:

operating a print head adjacent a rotatable intermediate transfer drum to eject ink droplets from said print head to form ink images on said intermediate transfer drum, said ink images having a top edge;

maintaining a coating of release agent on said intermediate transfer drum prior to formation of said ink images thereon to assist in a transfer of said ink images therefrom;

selectively moving a positionable transfixing roll at a transfixing station to form a transfixing nip with said intermediate transfer drum;

rotating both said transfixing roll and said intermediate transfer drum after said transfixing nip is formed;

transporting a recording medium through said transfixing nip, the recording medium having a leading edge and a trailing edge;

operating the transfixing station in a simplex transfixing mode to produce simplex prints and in a duplex transfixing mode to produce duplex prints, said simplex transfixing mode permitting some transfer of release agent from said intermediate transfer drum to said transfixing roll, while said duplex transfixing mode does not;

transporting said recording medium for a simplex print to said transfixing nip after said transfixing nip is formed;

disengaging said transfixing roll from said transfixing nip after said recording medium has exited from said transfixing nip;

establishing n simplex prints necessary to clean said transfixing roll of at least a portion of the release agent obtained from contact with said intermediate transfer drum during production of simplex prints;

subtracting n simplex prints from a total number Q of simplex prints to be printed;

establishing K number of simplex prints to be produced using said simplex transfixing mode by solving equation $Q-n=K$, if K is a positive number, said transfixing station being operating in said simplex transfixing mode to produce K simplex prints, and if K is not a positive number, then $Q=n$ and said transfixing station is operated in said duplex transfixing mode for n simplex prints; and converting said transfixing station from operating in said simplex transfixing mode to operating in said duplex transfixing mode when a last print of K simplex prints have been produced to enable the last n simplex prints to be produced by said duplex transfixing mode.

6. The method as claimed in claim 5, wherein the method further comprises:

rotating said intermediate transfer drum while said ink images are being formed thereon.

7. The method as claimed in claim 5, wherein transporting said recording medium further comprises:

stopping said intermediate transfer drum at said transfixing station with the top edge of said ink image registered at said transfixing station at a position where said transfixing nip is subsequently formed;

stopping said recording medium for a duplex print to register the leading edge of said recording medium with said top edge of said ink image on said intermediate transfer drum prior to formation of said transfixing nip;

rotating both said transfixing roll and said intermediate transfer drum after said transfixing nip has been formed; and moving said transfixing roll away from said intermediate transfer drum to disengage said transfixing roll from said transfixing nip prior to exit of said trailing edge of said recording medium from said transfixing nip.

8. An ink jet printer having multiple transfixing modes to enable printing of both simplex and duplex prints while increasing the printing speed thereof, comprising:

a rotatable intermediate transfer drum having a coating of release agent thereon;

a print head adjacent said rotatable intermediate transfer drum that ejects ink droplets onto the rotatable intermediate transfer drum to form ink images on said intermediate transfer drum, said ink images having a top edge;

a transfixing station located adjacent said intermediate transfer drum and downstream from said print head, the transfixing station having a movable transfixing roll adapted for movement towards and away from said intermediate transfer drum in order to form a transfixing nip therewith at said transfixing station;

a transporting device for delivering a recording medium to the transfixing nip, said recording medium having a leading edge and a trailing edge;

a controller and a memory for controlling the printer operating processes and for determining a timing sequence for forming said transfixing nip relative to entrance of said recording medium and said ink image on said intermediate transfer drum into said transfixing nip to control the transfer of said release agent from said intermediate transfer drum onto said transfixing roll, said controller being operatively coupled to the transfixing station to operate said transfixing station in a simplex transfixing mode for simplex prints and in a duplex transfixing mode for duplex prints, said simplex transfixing mode requiring said transfixing nip be formed prior to delivery of said leading edge of said recording medium to the transfixing nip and said transfixing roll be disengaged from said transfixing nip after said trailing edge of said recording medium has exited from said transfixing nip; and said controller enters a total number of simplex prints Q for a printing job into said memory and subtracts a number of simplex prints n stored in said memory that are necessary to clean release agent from said transfixing roll after simplex prints are produced, thus solving equation $Q-n=K$; wherein if K is not a positive number, then $Q=n$, and if K is a positive number, said controller operates said transfixing station in said simplex transfixing mode for K simplex prints; and wherein said controller converts said transfixing station from operating in said simplex transfixing mode to operating in said duplex transfixing mode upon completion of K simplex prints to enable a remaining n simplex prints to be produced by said transfixing station operating in the duplex transfixing mode to prepare said printer for a subsequent duplex printing job.

9. The ink jet printer as claimed in claim 8, wherein said duplex transfixing mode requires that said transfixing nip be formed after said recording medium is delivered to said transfixing nip location to sandwich the leading edge of said recording medium between said transfixing roll and said intermediate transfer drum when said transfixing nip is formed, and said duplex transfixing mode requires that said transfixing nip be disengaged prior to exit of the trailing edge of said recording medium from the transfixing nip to control the transfer of release agent from said intermediate transfer drum to said transfixing roll.

10. The ink jet printer as claimed in claim 9, wherein said intermediate transfer drum is stopped at said transfixing station with the top edge of said ink image registered at said transfixing location;

wherein said leading edge of said recording medium is positioned and registered with said top edge of said ink image on said intermediate transfer drum;

wherein said transfixing roll is moved toward said intermediate transfer drum to form said transfixing nip and capture said leading edge of said recording medium without contacting said intermediate transfer drum;

wherein said transfixing roll and said intermediate transfer drum are rotated to transport said recording medium through said transfixing nip to transfix said ink image to said recording medium; and wherein said transfixing roll is moved away from said intermediate transfer drum to disengage said transfixing nip prior to exit of said trailing edge of said recording medium.

11. The ink jet printer as claimed in claim 8, wherein if $Q=n$, then said controller operates said transfixing station in said duplex transfixing mode for all $Q=n$ simplex prints to prepare said printer for a possible next duplex printing job.

* * * * *